US007850538B1

(12) United States Patent
Yoon

(10) Patent No.: US 7,850,538 B1
(45) Date of Patent: Dec. 14, 2010

(54) GOLF CLUB HAVING TWO ANGULARLY DIVERGENT IMPACT FACES

(76) Inventor: Heung-Sub Yoon, 311-1501, Hyundai Home Town Apt. Beom Bak-Dong, Bucheon, Gyeonggi province (KR)

( * ) Notice: Subject to any disclaimer, the term of this patent is extended or adjusted under 35 U.S.C. 154(b) by 0 days.

(21) Appl. No.: 12/360,071

(22) Filed: Jan. 26, 2009

(51) Int. Cl.
*A63B 69/36* (2006.01)
*A63B 53/04* (2006.01)

(52) U.S. Cl. ..... 473/251; 473/324; 473/340; 473/409

(58) Field of Classification Search ..... 473/324–350, 473/219–256, 409
See application file for complete search history.

(56) References Cited

U.S. PATENT DOCUMENTS

| | | | | | |
|---|---|---|---|---|---|
| 1,334,189 | A | * | 3/1920 | Swanson | 473/306 |
| 2,530,446 | A | | 11/1950 | Beardsley | |
| 3,989,256 | A | * | 11/1976 | Cicero | 473/252 |
| 4,290,606 | A | * | 9/1981 | Maxwell | 473/569 |
| 4,383,690 | A | | 5/1983 | Maxwell | |
| 4,413,825 | A | * | 11/1983 | Sasse | 473/331 |
| 5,322,285 | A | | 6/1994 | Turner | |
| 5,333,873 | A | * | 8/1994 | Burke | 473/252 |
| 5,383,664 | A | * | 1/1995 | Epperson | 473/340 |
| 5,458,335 | A | | 10/1995 | Hattori | |
| 5,584,769 | A | | 12/1996 | Sundin | |
| 5,857,920 | A | * | 1/1999 | Hong | 473/240 |
| 6,183,380 | B1 | | 2/2001 | Yim | |
| 6,340,336 | B1 | * | 1/2002 | Loconte | 473/251 |
| 6,464,598 | B1 | | 10/2002 | Miller | |
| 7,163,463 | B2 | * | 1/2007 | Mills | 473/244 |
| 7,387,576 | B2 | * | 6/2008 | Agnew | 473/240 |
| 7,442,129 | B2 | | 10/2008 | Bardha | |

FOREIGN PATENT DOCUMENTS

| | | | |
|---|---|---|---|
| GB | 2.373.735 | | 2/2002 |
| GB | 2423723 | * | 9/2006 |
| JP | 9-66127 | * | 3/1997 |
| JP | 2001286587 | | 10/2001 |
| JP | 2003-10374 | * | 1/2003 |
| JP | 2004-16302 | * | 1/2004 |
| WO | WO02/18017 | | 3/2002 |
| WO | WO03/041815 | | 5/2003 |

* cited by examiner

*Primary Examiner*—Sebastiano Passaniti
(74) *Attorney, Agent, or Firm*—Michael I Kroll

(57) ABSTRACT

A dual purpose putting and chipping golf club has a golf club head with a golf ball impact face vertically split into a pair of angularly divergent impact surfaces; a vertical putting surface and an obtusely angled chipping surface which face in the same horizontal direction.

26 Claims, 7 Drawing Sheets

GOLF CLUB HAVING TWO ANGULARLY DIVERGENT IMPACT FACES

BACKGROUND OF THE INVENTION

1. Field of the Invention

The present invention relates generally to golf clubs and, more specifically, to a golf club head having an impact face split into a pair of angularly divergent golf ball impact surfaces. The golf club head has a vertical surface for putting and an obtusely angled surface for chipping the golf ball.

The present invention is a combination, double-faced putter and chipping club head used in golf to strike the golf ball. The chipping portion of the club head is used for a short approach shot of low trajectory usually hit from near the green or the edge of the green, and normally hit with an over spin or bite. The putter portion of the club head provides a straight face for putting on the green or putting surface.

2. Description of the Prior Art

There are other golf club impact faces designed for a similar purpose. Typical of these is U.S. Pat. No. 2,530,446 issued to Beardsley on May 8, 1947.

Another patent was issued to Maxwell on May 17, 1983 as U.S. Pat. No. 4,383,690. Yet another U.S. Pat. No. 5,322,285 was issued to Turner on Jun. 21, 1994 and still yet another was issued on Oct. 17, 1995 to Hattori as U.S. Pat. No. 5,458,335.

Another patent was issued to Sundin on Dec. 17, 1996 as U.S. Pat. No. 5,584,769. Yet another U.S. Pat. No. 6,183,380 was issued to Yim on Feb. 6, 2001. Another was issued to Miller on Oct. 15, 2002 as U.S. Pat. No. 6,464,598 and still yet another was issued on Oct. 28, 2008 to Bardha as U.S. Pat. No. 7,442,129.

Another patent was issued to Amos on Oct. 2, 2002 as UK Patent No. GB2373735. Japan Patent No. JP2001286587 was issued to Tatsuya on Oct. 16, 2001. An International patent application was published to Sosin on Mar. 7, 2002 as International Patent Publication No. WO0218017.

U.S. Pat. No. 2,530,446

Inventor: John Beardsley

Issued: Nov. 21, 1950

In a reversible golf club head, the combination which comprises a shaft having a substantially right angularly disposed base with a longitudinally disposed tongue having outwardly diverging side surfaces depending therefrom on the lower end thereof, a solid massive head extended the full length of the base and having a longitudinally disposed groove with inwardly converging sides positioned and secured in position on the said base of the shaft by the coacting tongue and groove of the base and head respectively, the under surface of the tongue of the base having a recess therein and said head having anopening therein in registering relation with the recess of the base, a ball mounted in the opening of the head and positioned to coact with the recess of the base for retaining the base, and a spring in the said opening in the head for urging the ball into the said recess of the tongue of the base.

U.S. Pat. No. 4,383,690

Inventor: Thomas Maxwell

Issued: May 17, 1983

A golf club includes a club head having two body members and a hosel. Each of the two body members has a planar striking face, and the two faces determine an angle of 90 degrees. Each of the two body members also has a back surface which is grooved to reduce weight. The hosel joins the body members near the vertex of the 90 degree angle. A club shaft is inserted into the hosel. Indicia are formed on the upper surfaces of each of the body members which are parallel to a bisector of the 90 degree cycle to aid in aligning the club with the golf ball and the cup into which the ball is to be putted. Tuned resonators are mounted on each of the body members opposite the point on each striking face where the striking faces are tangent to a golf ball touching both faces. The resonators produce audible sounds, which are a function of how the club head strikes a golf ball.

U.S. Pat. No. 5,322,285

Inventor: Terry Turner

Issued: Jun. 21, 1994

A golf putter has a hard grip or an all-metal grip, and the grip, shaft and head are formed of a single, stiff material, or materials having closely-related moduli of elasticity, into an integral structural element. It is cast, forged, bonded, or otherwise assembled, to achieve a stiff, but sensitive "feel" for the golfer. A low frequency "feel" and sound is obtained by the shaft being closed at both ends and by one or more sound chambers or resonating elements. No dissimilar materials are included between the "sweet spot" and the golfer's hands, including in the grip. In one embodiment, toe area loft of the head is greater than the center loft and the heel area loft is less than the center loft. The putter head toe area may be closed slightly and the heel area may be opened slightly. A bulge may be included in the heel or toe areas.

U.S. Pat. No. 5,458,335

Inventor: Noriyasu Hattori

Issued: Oct. 17, 1995

A golf club including a shaft connected to a club head having first leg with a putting face thereon and a second leg with a chipping or pitching surface thereon is disclosed. The shaft is rigidly mounted perpendicular to the club head and centrally along the length of the club head. The putting face is upright and is substantially parallel to the shaft of the golf club and designed for use in putting a golf ball. The chipping face is angled or sloped relative to the shaft and is designed for use in chipping a golf ball.

U.S. Pat. No. 5,584,769

Inventor: Donald Sundin

Issued: Dec. 17, 1996

A two-faced golf club for right-handed or left-handed golfers having a vertical shaft and putter blade with a top surface, a bottom surface, a putting face, a chipping face, and a front surface. The top surface and the putting face meet at an angle of about ninety degrees and the top surface and the chipping face meet at an angle of at least one hundred and thirty degrees relative to the vertical shaft. The vertical shaft meets the blade at a center point on the top surface of the putter blade allowing versatility for both right-handed and left-handed golfers. The bottom surfaces of the golf club are preferably rounded to prevent "stubbing" with the ground during play.

U.S. Pat. No. 6,183,380

Inventor: Hyung Jin Yim

Issued: Feb. 6, 2001

A putter benefiting from the use of a striking surface which is composed of a flat and a curved face. The faces are connected smooth and piece-wise so that the continuous striking surface is forgiving to putting inconsistencies.

U.S. Pat. No. 6,464,598

Inventor: Dale Miller

Issued: Oct. 15, 2002

A golf club has a club head with a wedge face, a rounded sole, and a putting face located along a blade area between the wedge face and a front portion of the rounded sole. The putting face is located at a height above the crown of the rounded sole so that the putting face strikes a golf ball above the equator of the ball to impart top spin when putting. The wedge face preferably has a 90 degree loft. The club can be used for short chips by placing the hands forward of the club head to "de-loft" the wedge face, and chipping in an otherwise conventional manner. Also, the wedge face can be closed in order to hit high lob shots. A leading apex on the club head located at the intersection of the wedge face, the rounded sole, the toe of the club head, and the putting face points forward when the wedge face is closed to hit a high lob shot. The grooves on the wedge face are aligned to impart backspin when the wedge face is closed so that the leading apex is facing towards the target. The sole of the club head near the leading apex is designed to allow the leading apex to dig easily into the ground or sand without digging too deeply to create a chunk shot.

UK Patent Number GB2373735

Inventor: Henry Amos

Issued: Oct. 2, 2002

A practice or training putter head has a ball striking face with a narrow, planar sweet spot and faces which extend rearwardly, at an angle, from the sweet spot to the ends of the putter head. The practice putter may be provided together with a normal or playing putter which has the same weight and shaft characteristics as the practice putter. The practice putter head may have sighting lines engraved on an upper surface. In use, a golf ball travels in the intended direction if struck by the sweet spot, but travels in an unwanted direction if struck by one of the angled faces. The angled faces exaggerate the missed intended line of the putt, thereby aiding a user to improve their stroke by training them to strike the ball with the sweet spot.

Japan Patent Number JP2001286587

Inventor: Yamane Tatsuya

Issued: Oct. 16, 2001

To provide a putter head of a golf club having plural faces allowing various putting corresponding to a distance from a putting position to a hole cup. This putter head has a first putting face, a second putting face, and a third putting face for putting a golf ball, the first, second and third putting faces are disposed at the substantially same height from a sole part, the first second and third putting surfaces are provided in order from a heel part side to a toe part side, and the first, second third hardness of a first, a second and third members forming the first, second and third putting faces are set in the order of decreasing in order.

International Patent Publication Number WO02/18017

Inventor: Howard Sosin

Published: Mar. 7, 2002

A block putter, usable with either a conventional or sidesaddle putting stance for a right-handed or left-handed golfer, having a head width in the range of about one half to about twice the width of a golf ball. The increased width and potentially increased weight of the putter head improve its performance both on the green and when hitting from the fringe, the fairway, or the rough, or out of the sand. The golfer may use the toe of the putter, rather than one of the faces, to strike the ball, for increased accuracy, especially on short putts. Alternatively, the golfer may putt in a sidesaddle stance with the traditional putter face using a putter having an elongated shaft. The elongated shaft is of such a length as to allow for the end of the shaft to rest on the golfer's shoulder and help stabilize the putt.

While these golf clubs may be suitable for the purposes for which they were designed, they would not be as suitable for the purposes of the present invention, as hereinafter described. The present invention provides a golf club having an impact face split into a pair of angularly divergent golf ball impact surfaces. The golf club head has a vertical surface for putting and an obtusely angled surface for chipping the golf ball.

The present invention is a combination, double faced putter and chipping club head used in golf to strike the golf ball. The chipping portion of the club head is used for a short approach shot of low trajectory usually hit from near the green or the edge of the green, and normally hit with an over spin or bite. The putter portion of the club head provides a straight face for putting on the green or putting surface.

SUMMARY OF THE PRESENT INVENTION

A primary object of the present invention is to provide a golf club having an impact face split into a pair of angularly divergent golf ball impact surfaces.

Another object of the present invention is to provide a golf club having an impact surface having a vertical surface for putting.

Yet another object of the present invention is to provide a golf club having an impact surface having an obtusely angled surface for chipping the golf ball.

Still yet another object of the present invention is to provide double faced putter and chipping club head used in golf to strike the golf ball. The chipping portion of the club head is used for a short approach shot of low trajectory usually hit from near the green or the edge of the green, and normally hit with an over spin or bite.

Another object of the present invention is to provide a putter portion of the club head having a vertical surface for putting on the green or putting surface.

Additional objects of the present invention will appear as the description proceeds.

The present invention overcomes the shortcomings of the prior art by providing a golf club having an impact face split into a pair of angularly divergent golf ball impact surfaces. The club has a vertical surface for putting and an obtusely angled surface for chipping the golf ball.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawings in which.

DESCRIPTION OF THE REFERENCED NUMERALS

Figure 1:
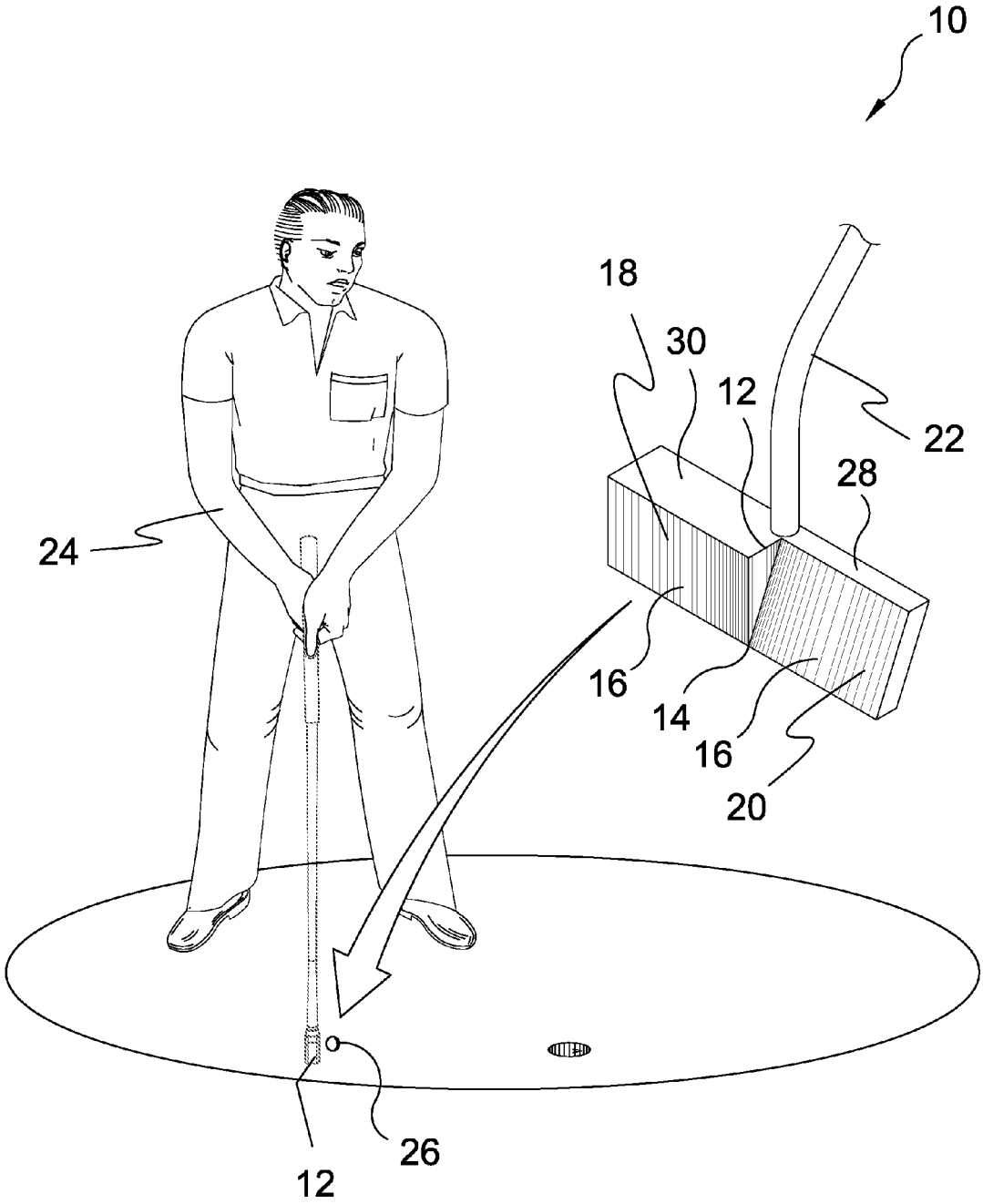
FIG. 1 is an illustrative view of the present invention in use.

Turning now descriptively to the drawings, in which similar reference characters denote similar elements throughout the several views, the figures illustrate the combination putting and chipping golf club of the present invention. With regard to the reference numerals used, the following numbering is used throughout the various drawing figures.

10 combination putting and chipping golf club
12 golf club head
14 golf ball impact face
16 pair of angularly divergent impact surfaces
18 vertical putting surface
20 obtusely angled chipping surface
22 golf club shaft
24 golfer
26 golf ball
28 heel portion of golf club head
30 toe portion of golf club head

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention in use. The present invention is a combination putting and chipping golf club 10 comprising a dual purpose golf club head 12 having a golf ball impact face 14 vertically split into a pair of angularly divergent impact surfaces 16, a vertical putting surface 18 and an obtusely angled chipping surface 20, with a golf club shaft 22 affixed to the golf club head 12. The putting surface 18 and the chipping surface 20 of the golf club head 12 face in the same horizontal direction, with the golf club head 12 preferably formed of a single piece of material. Shown are the putting surface 18 and the chipping surface 20 each taking up about half of the surface area of the golf ball impact face 14. Also shown is an embodiment of the invention wherein the golf club shaft 22 is affixed angularly to the golf club head 12 such that, when a golfer 24 addresses a golf ball 26 with the golf club 10, the golf club head 12 has a heel portion 28 facing toward the golfer 24 and a toe portion 30 facing away from the golfer 24. The chipping surface 20 is shown at the heel portion 28, but can alternatively be situated at the toe portion 30. The putting surface 18 is shown at the toe portion 30, but can alternatively be situated at the heel portion 28 of the golf club head 12.

Figure 2:
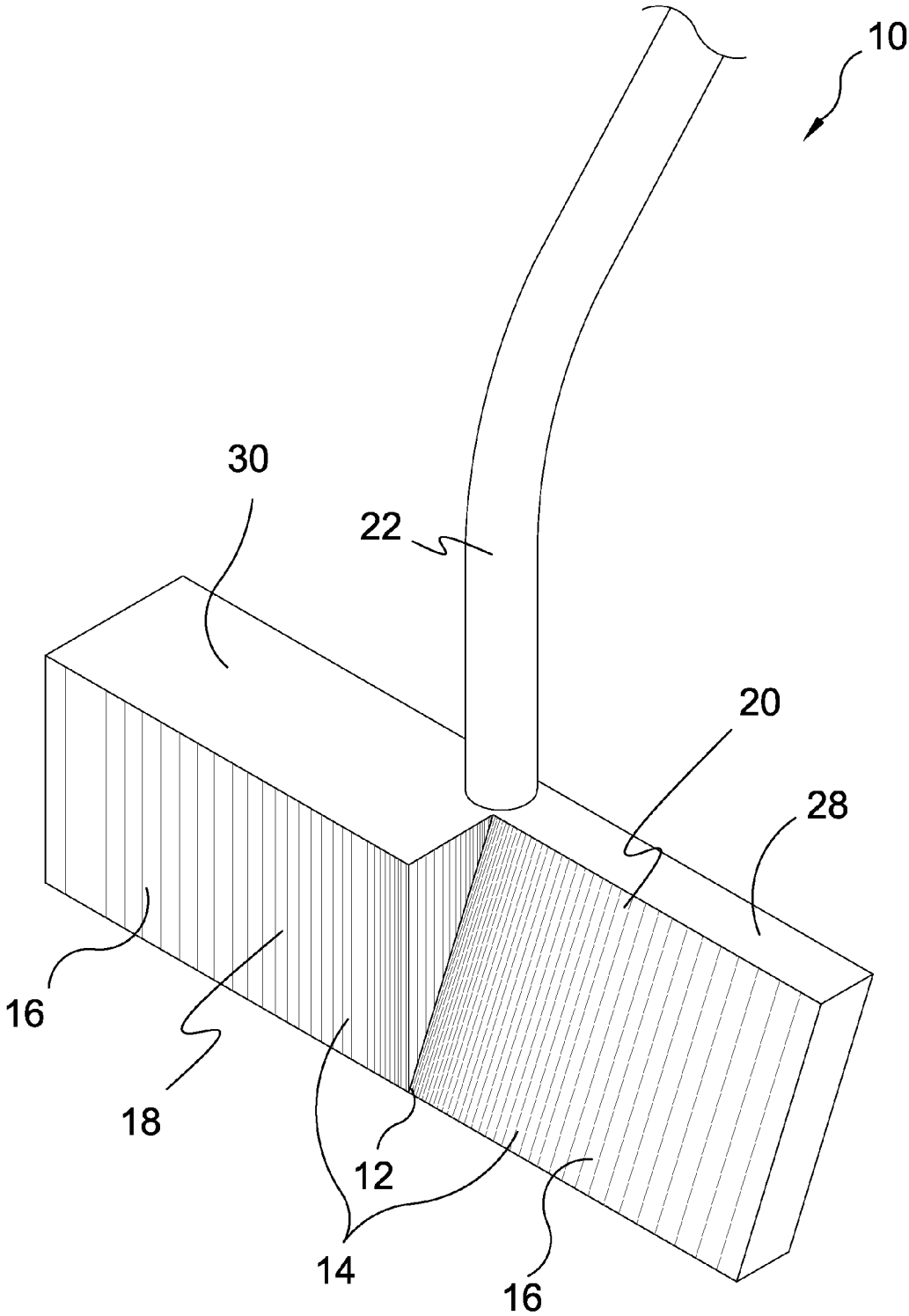
FIG. 2 is a perspective view of the present invention.

FIG. 2 is a perspective view of the present invention. Shown is the present invention, a combination putting and chipping golf club 10 comprising a dual purpose golf club head 12 having a golf ball impact face 14 vertically split into a pair of angularly divergent impact surfaces 16, a vertical putting surface 18 and an obtusely angled chipping surface 20, with a golf club shaft 22 affixed to the golf club head 12. The putting surface 18 and the chipping surface 20 of the golf club head 12 face in the same horizontal direction, with the golf club head 12 preferably formed of a single piece of material. Shown are the putting surface 18 and the chipping surface 20 each taking up about half of the surface area of the golf ball impact face 14. Also shown is an embodiment of the invention wherein the golf club shaft 22 is affixed angularly to the golf club head 12 such that, when a golfer addresses a golf ball with the golf club 10, the golf club head 12 has a heel portion 28 facing toward the golfer and a toe portion 30 facing away from the golfer. The chipping surface 20 is shown at the heel portion 28, but can alternatively be situated at the toe portion 30. The putting surface 18 is shown at the toe portion 30, but can alternatively be situated at the heel portion 28 of the golf club head 12.

Figure 3:
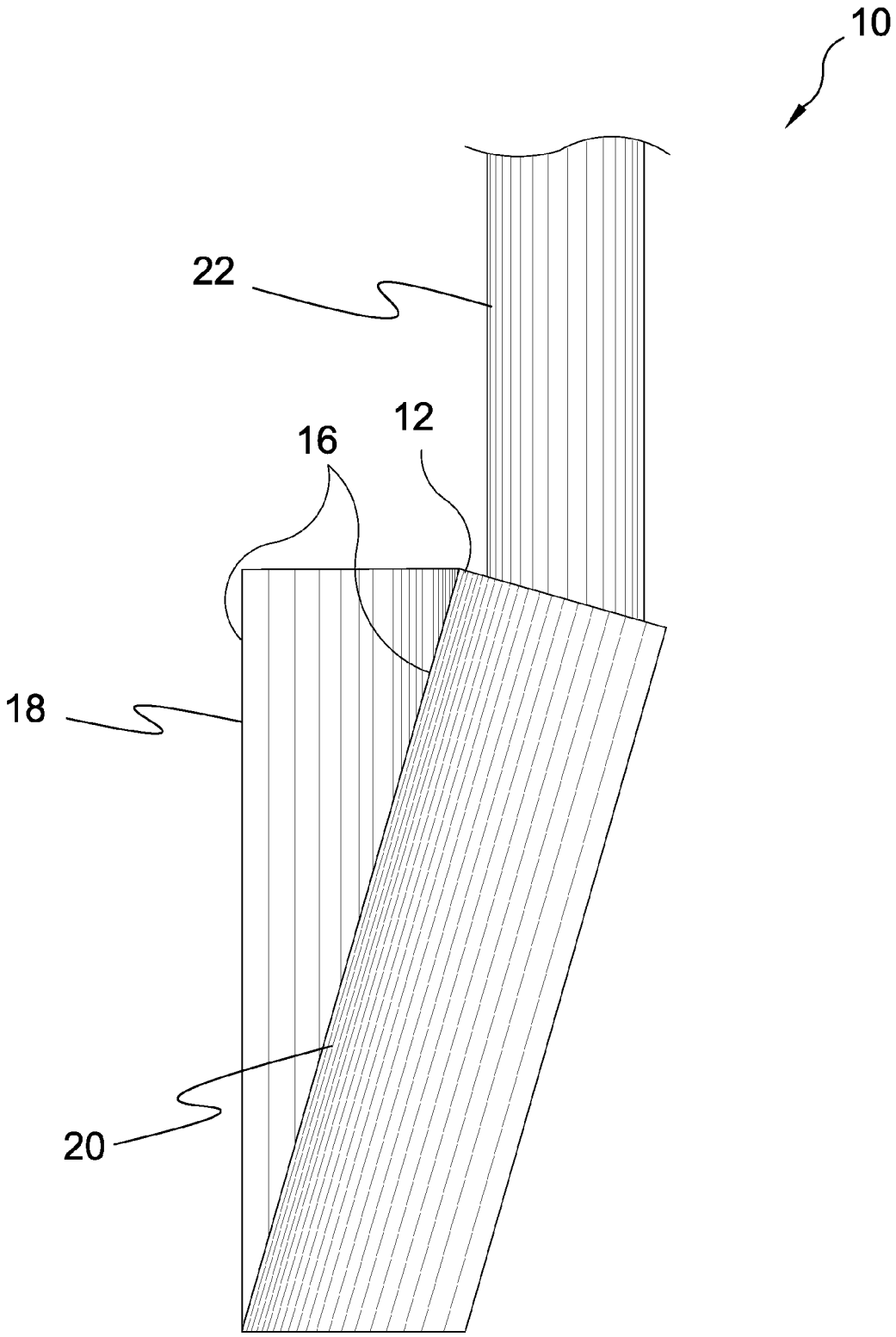
FIG. 3 is a side view of the present invention.

FIG. 3 is a side view of the present invention. Shown is a side view of the combination putting and chipping golf club 10 comprising a dual purpose golf club head 12 having a golf ball impact face vertically split into a pair of angularly divergent impact surfaces 16, a vertical putting surface 18 and an obtusely angled chipping surface 20, with a golf club shaft 22 affixed to the golf club head 12.

Figure 4:
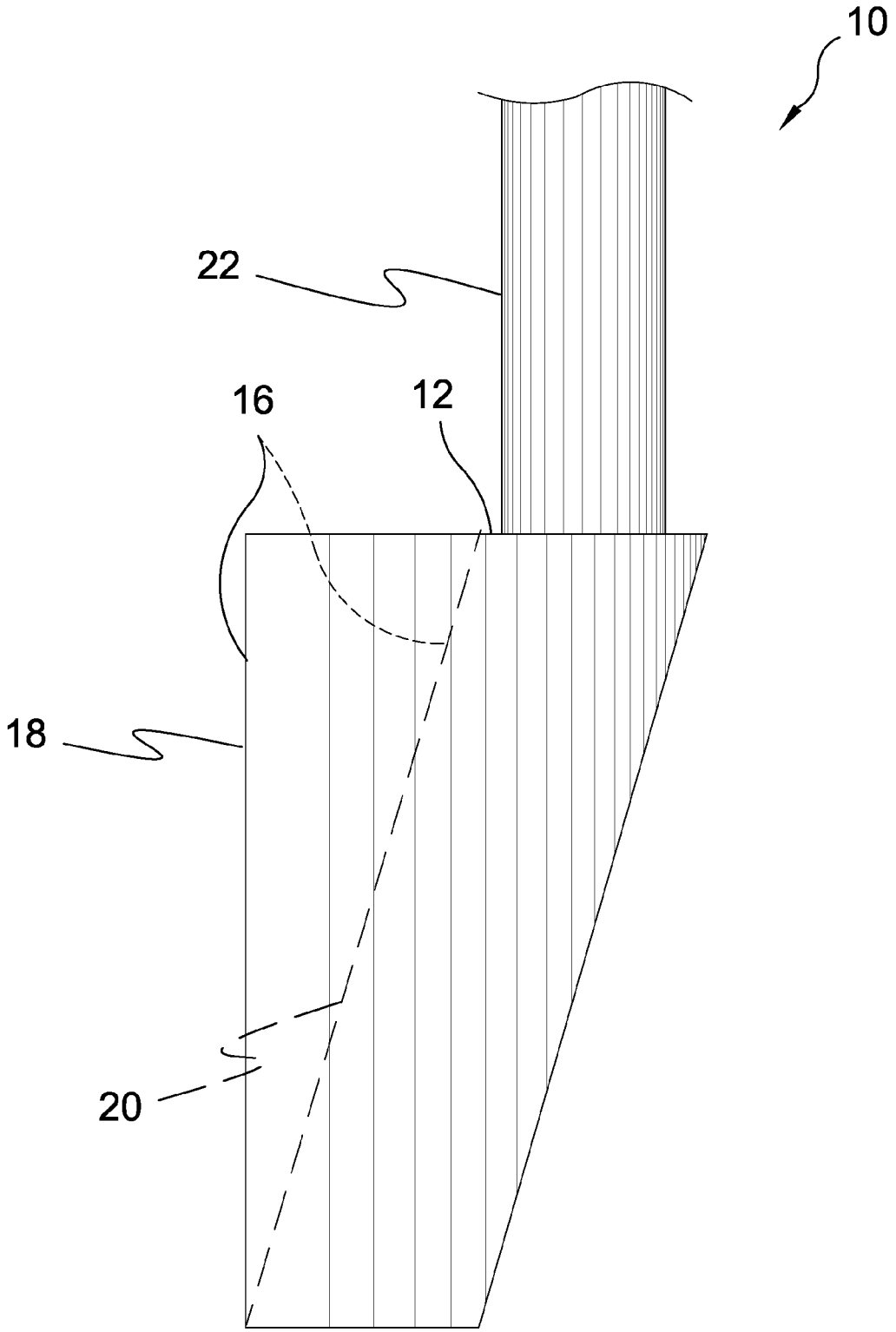
FIG. 4 is a side view of the present invention.

FIG. 4 is a side view of the present invention. Shown is the other side view of the combination putting and chipping golf club 10 comprising a dual purpose golf club head 12 having a golf ball impact face vertically split into a pair of angularly divergent impact surfaces 16, a vertical putting surface 18 and an obtusely angled chipping surface 20, with a golf club shaft 22 affixed to the golf club head 12.

Figure 5:
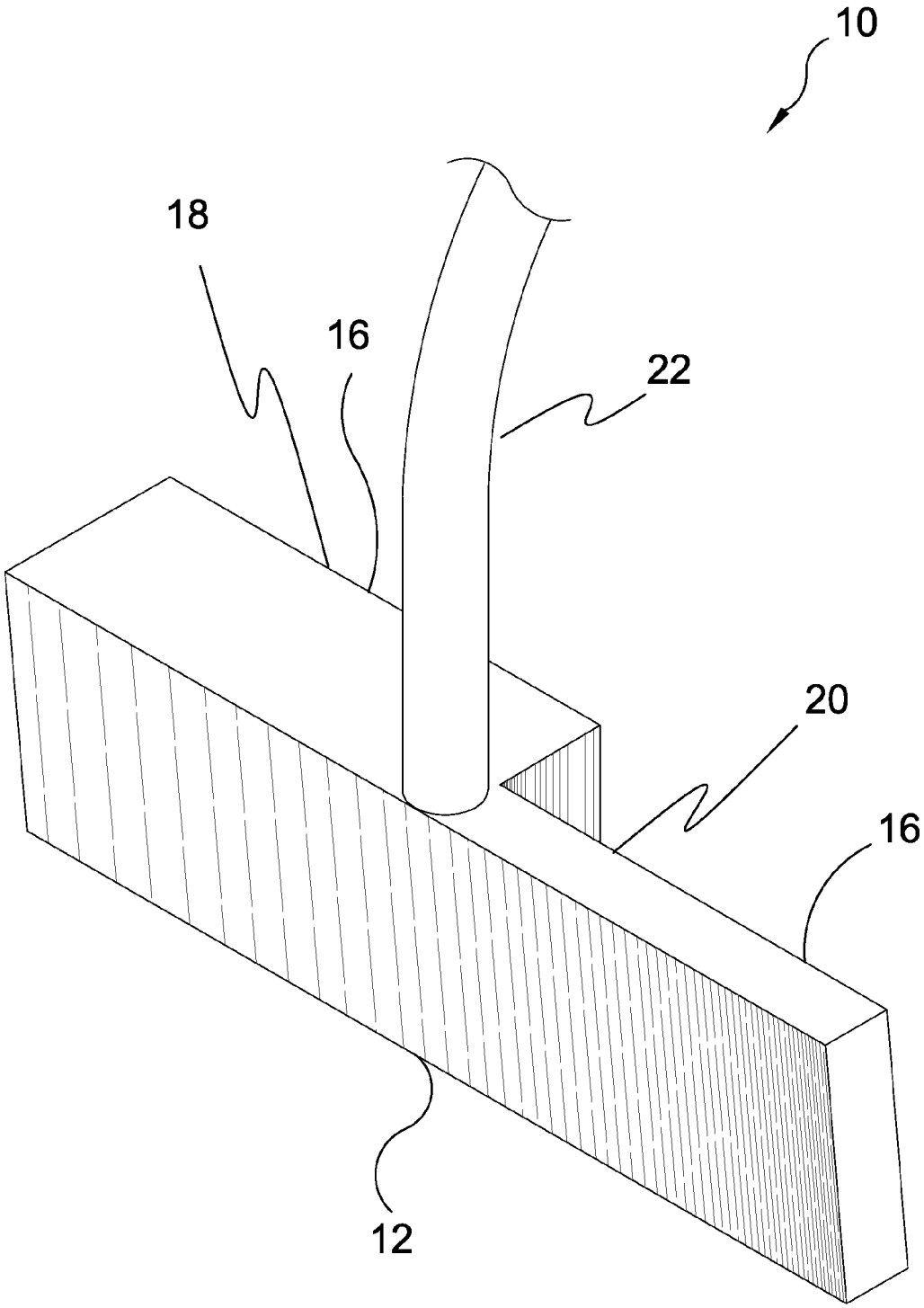
FIG. 5 is a rear view of the present invention.

FIG. 5 is a rear view of the present invention. Shown is a rear view of the present invention, a combination putting and chipping golf club 10 comprising a dual purpose golf club head 12 having a golf ball impact face vertically split into a pair of angularly divergent impact surfaces 16, a vertical putting surface 18 and an obtusely angled chipping surface 20, with a golf club shaft 22 affixed to the golf club head 12.

Figure 6:
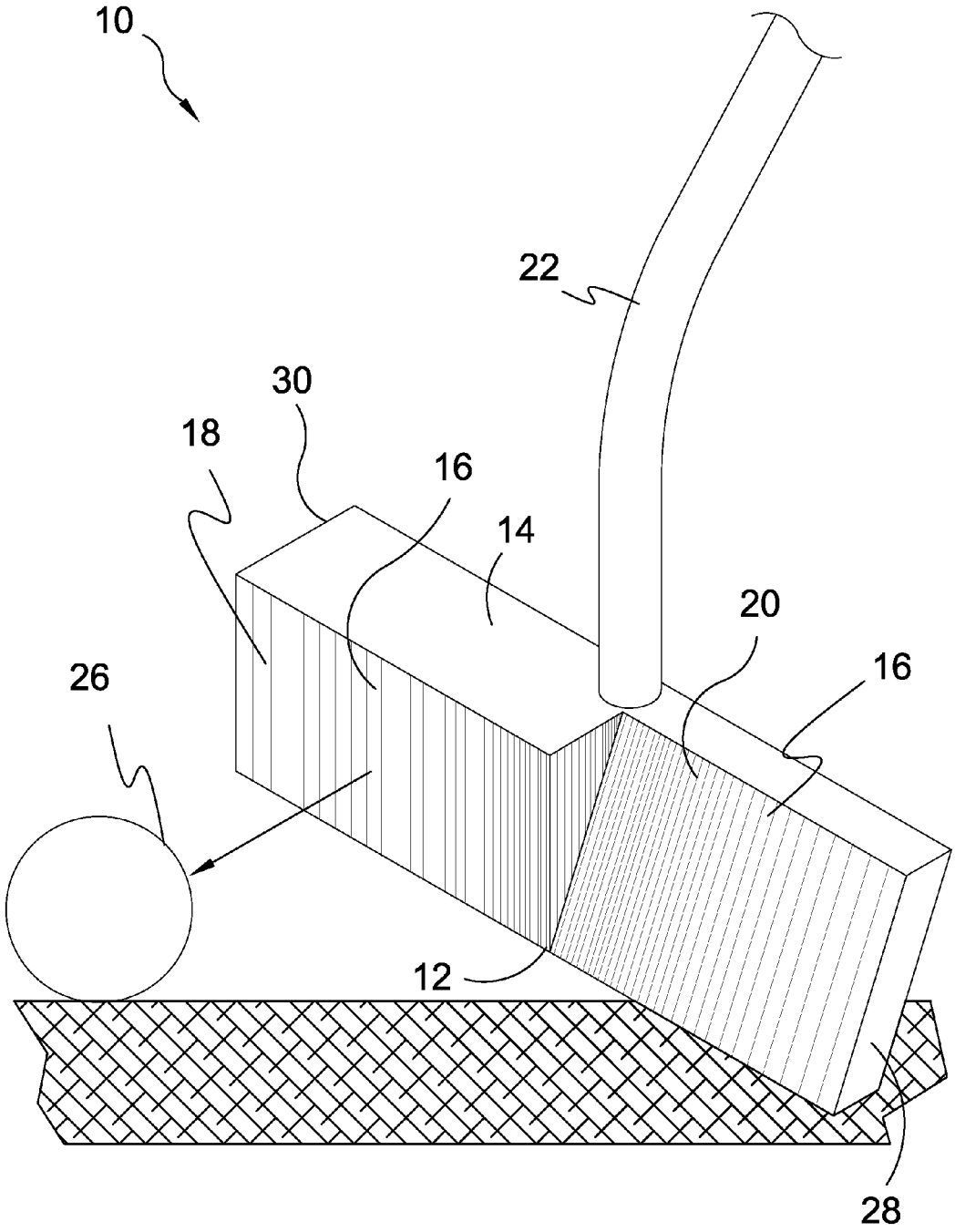
FIG. 6 is a perspective view of the present invention in use.

FIG. 6 is a perspective view of the present invention in use. Shown is the putting surface 18 of the golf club head 12 in use. The present invention is a combination putting and chipping golf club 10 comprising a dual purpose golf club head 12 having a golf ball impact face 14 vertically split into a pair of angularly divergent impact surfaces 16, a vertical putting surface 18 and an obtusely angled chipping surface 20, with a golf club shaft 22 affixed to the golf club head 12. The putting surface 18 and the chipping surface 20 of the golf club head 12 face in the same horizontal direction, with the golf club head 12 preferably formed of a single piece of material. Shown are the putting surface 18 and the chipping surface 20 each taking up about half of the surface area of the golf ball impact face 14. Also shown is an embodiment of the invention wherein the golf club shaft 22 is affixed angularly to the golf club head 12 such that, when a golfer addresses a golf ball 26 with the golf club 10, the golf club head 12 has a heel portion 28 facing toward the golfer and a toe portion 30 facing away from the golfer. The chipping surface 20 is shown at the heel portion 28, but can alternatively be situated at the toe portion 30. The putting surface 18 is shown at the toe portion 30, but can alternatively be situated at the heel portion 28 of the golf club head 12.

Figure 7:
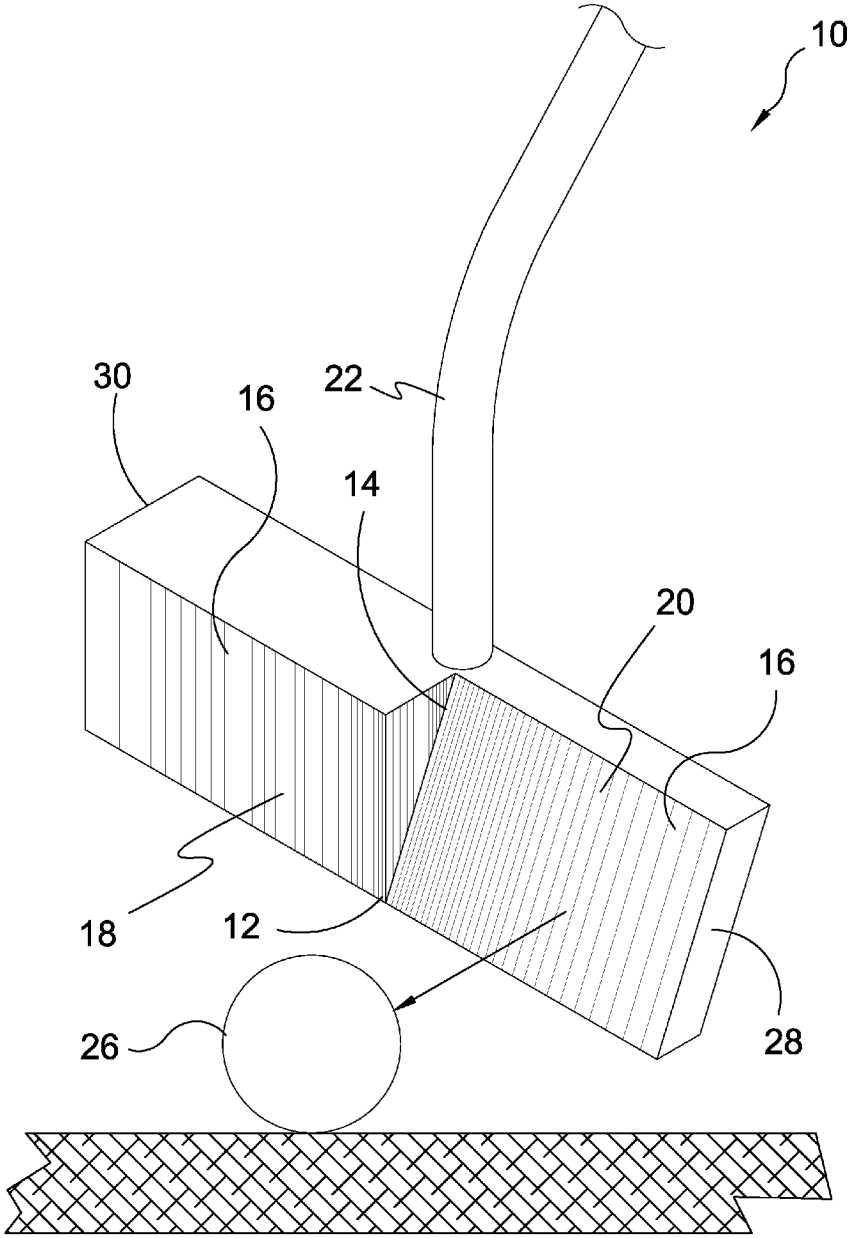
FIG. 7 is a perspective view of the present invention in use.

FIG. 7 is a perspective view of the present invention in use. Shown is the chipping surface 20 of the golf club head 12 in use. The present invention is a combination putting and chipping golf club 10 comprising a dual purpose golf club head 12 having a golf ball impact face 14 vertically split into a pair of angularly divergent impact surfaces 16, a vertical putting surface 18 and an obtusely angled chipping surface 20, with a golf club shaft 22 affixed to the golf club head 12. The putting surface 18 and the chipping surface 20 of the golf club head 12 face in the same horizontal direction, with the golf club head 12 preferably formed of a single piece of material. Shown are the putting surface 18 and the chipping surface 20 each taking up about half of the surface area of the golf ball impact face 14. Also shown is an embodiment of the invention wherein the golf club shaft 22 is affixed angularly to the golf club head 12 such that, when a golfer addresses a golf ball 26 with the golf club 10, the golf club head 12 has a heel portion 28 facing toward the golfer and a toe portion 30 facing away from the golfer. The chipping surface 20 is shown at the heel portion 28, but can alternatively be situated at the toe portion 30. The putting surface 18 is shown at the toe portion 30, but can alternatively be situated at the heel portion 28 of the golf club head 12.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed is:

1. A dual purpose golf club head comprising:

a) a golf ball impact face split into a pair of angularly divergent impact surfaces, each of said impact surfaces terminating at an upper end in a horizontal first surface, an opening in said horizontal first surface for receiving a shaft;

b) a vertical putting surface as a first of said pair of impact surfaces;

c) an obtusely angled chipping surface as a second of said pair of impact surfaces;

d) wherein said putting surface and said chipping surface face in the same horizontal direction.

2. A dual purpose golf club head according to claim 1, wherein said golf club head is formed of a single piece of material.

3. A dual purpose golf club head according to claim 1, wherein said golf ball impact face is vertically split into said putting surface and said chipping surface.

4. A dual purpose golf club head according to claim 1, wherein said putting surface and said chipping surface each comprise about half of said golf ball impact face.

5. A dual purpose golf club head according to claim 1, further comprising a golf club shaft affixed to said golf club head.

6. A dual purpose golf club head according to claim 5, wherein said golf club shaft is affixed angularly to said golf club head such that said golf club head comprises a heel portion and a toe portion, said heel portion facing toward a golfer using said golf club head and said toe portion facing away from a golfer using said golf club head.

7. A dual purpose golf club head according to claim 6, wherein said chipping surface is situated at said heel portion and said putting surface is situated at said toe portion of said golf club head.

8. A dual purpose golf club head according to claim 6, wherein said chipping surface is situated at said toe portion and said putting surface is situated at said heel portion of said golf club head.

9. A dual purpose golf club head according to claim 1, wherein said golf club head is formed of a single piece of material.

10. A dual purpose golf club head according to claim 9, wherein said golf ball impact face is vertically split into said putting surface and said chipping surface.

11. A dual purpose golf club head according to claim 10, wherein said putting surface and said chipping surface each comprise about half of said golf ball impact face.

12. A dual purpose golf club head according to claim 11, further comprising a golf club shaft affixed to said golf club head.

13. A dual purpose golf club head according to claim 12, wherein said golf club shaft is affixed angularly to said golf club head such that said golf club head comprises a heel portion and a toe portion, said heel portion facing toward a golfer using said golf club head and said toe portion facing away from a golfer using said golf club head.

14. A dual purpose golf club head according to claim 13, wherein said chipping surface is situated at said heel portion and said putting surface is situated at said toe portion of said golf club head.

15. A dual purpose golf club head according to claim 13, wherein said chipping surface is situated at said toe portion and said putting surface is situated at said heel portion of said golf club head.

16. A combination putting and chipping golf club comprising:

a) a golf club head having a golf ball impact face split into a pair of angularly divergent impact surfaces, each of said impact surfaces terminating at an upper end in a first horizontal surface, a vertical putting surface as a first of said pair of impact surfaces and an obtusely angled chipping surface as a second of said pair of impact surfaces;

b) a golf club shaft affixed to said golf club head in said first horizontal surface; and c) wherein said putting surface and said chipping surface face in the same horizontal direction.

17. A combination putting and chipping golf club according to claim 16, wherein said golf club head is formed of a single piece of material.

18. A combination putting and chipping golf club according to claim 17, wherein said golf ball impact face is vertically split into said putting surface and said chipping surface.

19. A combination putting and chipping golf club according to claim 18, wherein said putting surface and said chipping surface each comprise about half of said golf ball impact face.

20. A combination putting and chipping golf club according to claim 19, wherein said golf club shaft is affixed angularly to said golf club head such that said golf club head comprises a heel portion and a toe portion, said heel portion facing toward a golfer using said golf club head and said toe portion facing away from a golfer using said golf club head.

21. A combination putting and chipping golf club according to claim 20, wherein said chipping surface is situated at said heel portion and said putting surface is situated at said toe portion of said golf club head.

22. A combination putting and chipping golf club according to claim 20, wherein said chipping surface is situated at said toe portion and said putting surface is situated at said heel portion of said golf club head.

23. A method for manufacturing a combination putting and chipping golf club comprising the steps:

a) providing a golf club head having a golf ball impact face split into a pair of angularly divergent impact surfaces, a vertical putting surface as a first of said pair of impact surfaces and an obtusely angled chipping surface as a second of said pair of impact surfaces;

b) affixing a golf club shaft to said golf club head into a horizontal surface above the impact face, each of said impact surfaces terminating at an upper end in said horizontal surface;

c) said putting surface and said chipping surface face in the same horizontal direction.

24. A method for manufacturing a combination putting and chipping golf club according to claim 23, wherein:

a) said golf club head is formed of a single piece of material; and b) said golf ball impact face is vertically split into said putting surface and said chipping surface.

25. A method for manufacturing a combination putting and chipping golf club according to claim 24, wherein said putting surface and said chipping surface each comprise about half of said golf ball impact face.

26. A method for manufacturing a combination putting and chipping golf club according to claim 25, wherein said golf club shaft is affixed angularly to said golf club head such that said golf club head comprises a heel portion and a toe portion, said heel portion facing toward a golfer using said golf club head and said toe portion facing away from a golfer using said golf club head.

* * * * *